United States Patent [19]

Davis et al.

[11] 3,991,904

[45] Nov. 16, 1976

[54] HINGED CLOSURES

[75] Inventors: Eugene Edward Davis, Barkingside; Brian Leslie Miskin, Chislehurst, both of England

[73] Assignee: Johnsen & Jorgensen (Plastics) Ltd., London, England

[22] Filed: June 4, 1975

[21] Appl. No.: 583,682

Related U.S. Application Data

[63] Continuation-in-part of Ser. No. 345,138, March 26, 1973, abandoned.

[52] U.S. Cl. ..... 220/334; 215/320; 215/256; 215/321; 215/305

[51] Int. Cl.[2] ..... B65D 51/04

[58] Field of Search ..... 220/334, 367; 215/320, 215/256, 257, 349, 305, 321

[56] References Cited

UNITED STATES PATENTS

| | | | |
|---|---|---|---|
| 2,880,744 | 4/1959 | Daley | 220/367 |
| 3,080,991 | 3/1963 | Fox | 215/257 |
| 3,131,824 | 5/1964 | Van Baarn | 215/256 |
| 3,235,117 | 2/1966 | Mason | 215/256 |
| 3,272,368 | 9/1966 | Van Baarn | 215/320 |
| 3,441,161 | 4/1969 | Van Baarn | 215/320 |
| 3,559,833 | 2/1971 | Alonso | 215/349 |
| 3,622,028 | 11/1971 | Lohrer | 215/320 |
| 3,696,957 | 10/1972 | Van Baarn | 215/320 |

*Primary Examiner*—R. E. Hart
*Attorney, Agent, or Firm*—Newton, Hopkins & Ormsby

[57] ABSTRACT

A plastics container and closure assembly in which the closure has a cap part, a tear away band, an anchor band, a hinge connecting the cap part to the anchor band and a bung to seat within the mouth of the container. The bung is deeper on one side than on the other whereby when viewed from one side the bottom of the bung is formed by an oblique line extending upwardly from the deepest part of the bung to the shallowest part and wherein the shallowest part of the bung is adjacent to a thumb tab by which the cap may be manipulated and the deepest part of the bung is adjacent to the hinge. The anchor band has an auxiliary band retaining projection positioned when in use below the auxiliary bead on the container and a main band-retaining projection when in use below the main band-retaining bead the arrangement being such that when the tear-off strip is removed the cap part remains connected to the anchor band by a hinge and the anchor band is firmly held in position.

3 Claims, 6 Drawing Figures

HINGED CLOSURES

This application is a continuation-in-part of application Ser. No. 345,138 filed by Brian Leslie Miskin and Eugene Edward Davis on Mar. 26, 1973 and now abandoned.

This invention relates to a plastics container and closure assembly in which the closure comprises a cap part, a tear-off strip and an anchor band which, when the tear-off strip has been removed is connected to the anchor band by a hinge. Closures of the above type have enjoyed a substantial commercial success in the last fifteen or so years and are sometimes called captive cap closures. Captive cap closures were originally constructed substantially in accordance with FIG. 1 of U.S. Pat. No. 3,441,161 including a shallow annular bung to seat inside the mouth of the container and a prong-like projection to serve as a stop by resting against the rim of the container when the cap was open as shown in FIG. 5 of U.S. Pat. No. 3,441,161.

Captive cap closures were originally intended for use with glass containers for example glass soft drink bottles such as orange squash bottles and with such glass containers the captive cap closures were very successful. The closures remained tightly in position as the cap part was manipulated, the bung made an effective seal for the contents when the cap part was in closed position and the prong functioned efficiently to hold the cap part in its open position. For use with glass containers therefore a closure as illustrated in FIG. 5 of U.S. Pat. No. 3,441,161 was satisfactory.

However in recent years there has been a trend towards the use of containers made of plastics material and a demand developed for a captive cap closure for use with a plastics container. Naturally it was considered at first that the same closure that had been used so successfully with glass containers would meet the requirement for a captive cap closure for plastics containers. However experiments and tests soon showed that this was not the case. Several problems immediately presented themselves some of which were as follows:

1. The prong inside the cap part caught against a rim at the mouth of the plastics container so that reclosure was often difficult. This was due to the method of manufacture of plastics containers which involved a moulding step which almost always left a small rim or chimney of flash standing up around the mouth of the bottle and it was against this rim that the prong was apt to catch.
2. Owing to the difficulty of re-closing the cap part it was common for the anchor band to ride-up the neck making reclosure even more awkward.
3. For various reasons there was a leakage problem. For example there was complete reliance on the accuracy of the bore in the container mouth for the provision of a seal. Such accuracy was difficult to achieve with plastics containers and 'leakers' were common.
4. In an attempt to overcome this difficulty above a rather complicated neck profile was proposed for the plastics container but this led to another difficulty in that the neck profile selected presented problems to the container makers particularly in moulding the outer edge of the container around the mouth accurately to size and shape without frequent recourse to container neck mould maintenance or replacement and they pleaded with the closure makers to simplify the profile design required so as to make it possible to improve the reliability of the moulds.
5. It was found that the leakage problem was partly caused by the fact that there was always a tendency to get a cap sealing bung deformation adjacent to the prong which in turn caused an integral sealing bead to become ineffective.

The above problems caused the introduction of plastics containers to be held up and also meant that when plastics containers were used captive caps in many cases could not be employed. In order to overcome the problems a series of developments, experiments and trials were carried out as a result of which improvements have been made which have led to a wide and increasing use of captive cap closures with plastics containers. The improvements have included redesigning the closure to meet the difficulties and also redesigning the neck profile of the container.

The closure has been redesigned by eliminating entirely the prong like projection and deepening and shaping the bung to assist not only in preventing leakage but also in guiding the cap part back into position when replacing the cap part. The neck profile has been improved by providing a main external bead and an auxiliary external bead for co-operation with a modified anchor band with an internal profile for engagement with the beads. In addition a primary internal sealing bead is provided remote from the mouth of the container and its accuracy is more easily controlled.

In order that the invention may be more clearly understood and readily carried into effect reference is now directed to the accompanying drawings given by way of example in which.

Figure 1:
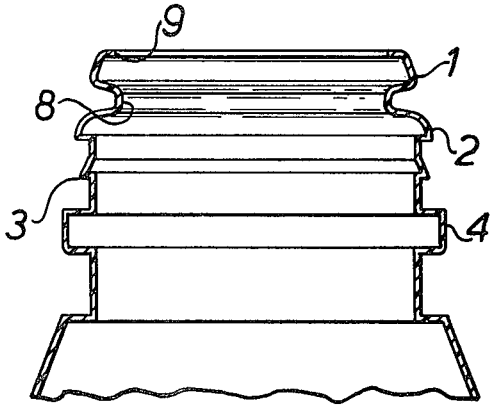
FIG. 1 is a vertical section showing the neck profile of a plastics container.

FIG. 1 illustrates an improved neck profile for a plastics container including a snap over bead 1, a main band retaining bead 2, an auxiliary band retaining bead 3 and a collar 4.

Figure 2:
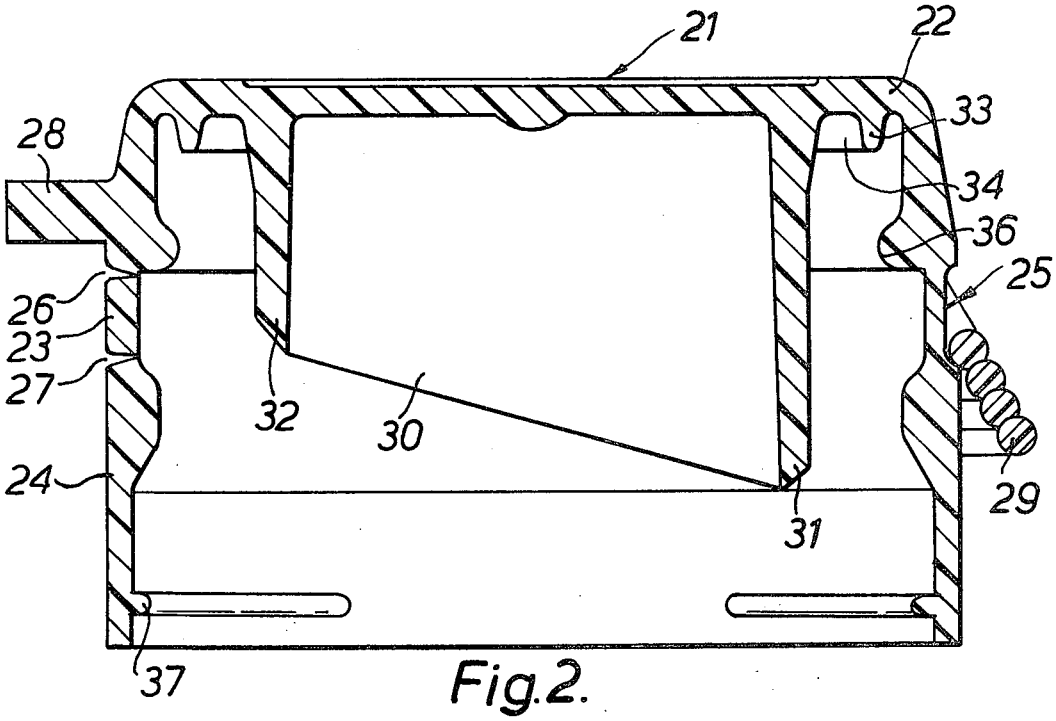
FIG. 2 is a vertical section of a captive cap closure for co-operation with the container shown in FIG. 1.

FIG. 2 illustrates an improved captive cap closure 21 for cooperation with a plastics container having a neck profile as illustrated in FIG. 1. The closure 21 has a cap part 22, a tear band 23 and an anchor band 24, the anchor band being connected to the cap part 22 by a hinge 25 and the tear band being removable by tearing along weakened lines 26 and 27. The cap part 22 has a thumb tab 28 opposite to the hinge 25 and the tear band 23 has a grip 29. The cap part 22 also has an annular bung 30 which has a deep end 31 and a shallow end 32 so that when viewed from the side as in FIG. 2 the deep end 31 which is adjacent to the grip 29, is joined to the shallow end 32, which is adjacent to the tab 28, by an oblique line.

Figure 4:
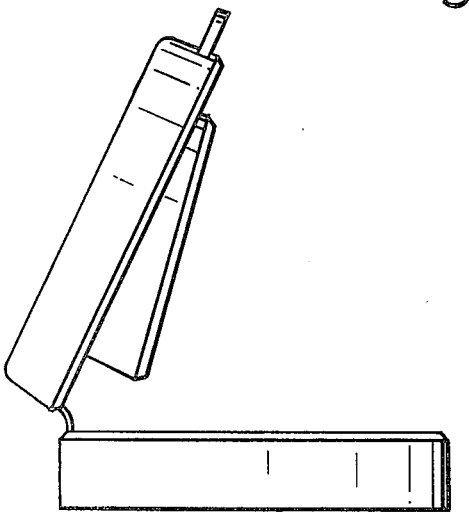
FIG. 4 is a side elevation with the cap part fully open.
Figure 5:
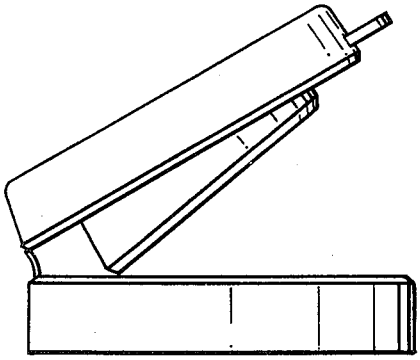
FIG. 5 is a view similar to FIG. 4 with the cap part partially closed.
Figure 6:
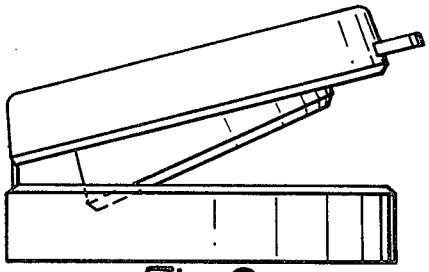
FIG. 6 is a view similar to FIGS. 4 and 5 with the cap part nearly closed.
Figure 3:
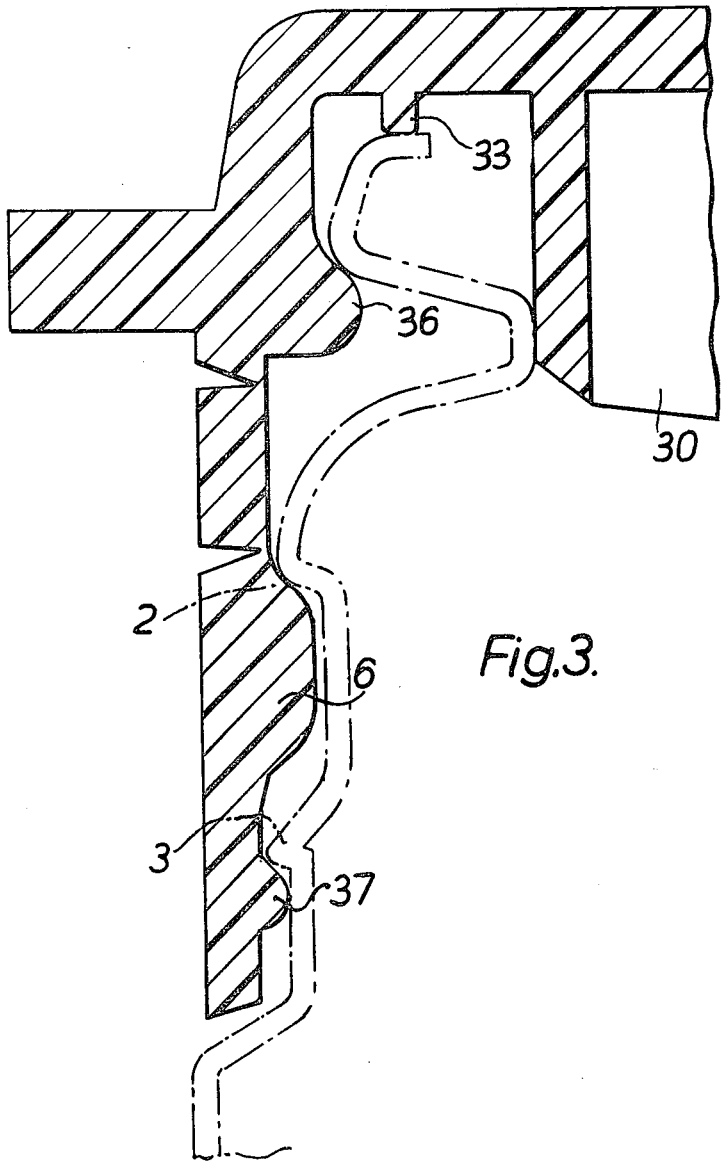
FIG. 3 is a partial sectional view showing the captive cap closure in position one side only being shown and the container being drawn in dot and dash lines.

It will be noted that the cap part also has an annular sealing ring 33 leaving a recess 34 between the ring 33 and the bung 30. When the cap part is closed down over the container mouth, if pressure be applied to the cap part so that the rim around the container mouth is seated within the recess 34 very effective sealing is provided by the wedging effect of the container rim within the recess 34. In operation the deep end of the bung 30 acts against the rim of the plastics container to retain the cap part in its open position as shown in FIG. 4 and also acts to guide the bung 30 back into the mouth of the container as the cap part is being moved into its closed position as shown in FIGS. 5 and 6. The cap part 22 also has an annular cap-retaining and sealing ring 36 which seats against the outside of the neck profile of the container. Below the tab 28 the anchor band is provided with an inturned arcuate lip 37 as an additional measure of protection to prevent the band riding up as the tab 28 is pushed down to reclose the cap part. Naturally if desired more than one external auxiliary bead may be provided on the container and more than one internal auxiliary projection may be provided on the anchor band. The diameter of the container below a lower auxiliary bead may be greater than the diameter below an upper auxiliary bead. FIG. 3 illustrates the outline drawing of a container closure fitting on to the neck of a plastics container as illustrated in FIG. 1 As shown in FIG. 3 the closure has a cap-retaining and sealing internal projection 36 to fit under the snap-over bead 1 to hold the cap part in place. The closure also has a first internal main projection 6 on the anchor band to fit under the main band-retaining bead 2 and a second auxiliary projection 7 on the anchor band to fit under the auxiliary bead 3. Reference to FIG. 3 will show that the mouth or upper edge of the container really plays no part in the sealing effected by the closure. The bung 30 depends into the mouth of the container the neck of which at a position spaced from the upper edge has an annular internal rim 8 which has an internal diameter less than that of the mouth 9 of the container so that the bung 30 slide freely into the mouth of the container and seats against the rim 8 as the bung is pushed into position. The removal of the sealing position from the mouth of the container to a position spaced from the mouth has proved to be very important in overcoming the difficulties of the container manufacturers because it has proved almost impossible to control accurately the shape and dimensions of the actual mouth of a plastics container except at considerable recurring costs due to manufacturing problems in the moulding but it is possible to control accurately the size and shape of the internal rim 8 spaced from the mouth.

What is claimed is:

1. A container and closure therefor comprising:

a container having a neck terminating in a rim defining a mouth of circular plan shape, said neck having an external snap over bead disposed below said mouth and an external main band retaining bead below said snap over bead, said neck having an internal bead below said rim which defines a circular sealing surface of smaller diameter than and disposed below said mouth; and a closure including a cap part, a tear-off strip and an anchor band presenting an internal projection positioned below said main band retaining bead, said cap part having an internal projection positioned below said snap over bead and there being a hinge joining said cap part to said anchor band so that when the tear-off strip is removed the cap part may be swung aside to uncover said neck while remaining attached to the anchor band, said cap part including a thumb tab opposite said hinge and a bung having an external diameter corresponding to that of said sealing surface and being of a length sufficient to be embraced by said sealing surface, said bung being shaped so that the bung is deeper on one side than on the other whereby when viewed from one side the bottom of the bung is formed by an oblique line extending upwardly from the deepest part of the bung to the shallowest part and wherein the shallowest part of the bung is adjacent to said thumb tab by which the cap may be manipulated and the deepest part of the bung is adjacent to the hinge.

2. The container and closure combination as defined in claim 1 wherein said neck is of substantially uniform wall thickness, said external snap over bead and said main retaining bead being separated by a valley which, due to said uniform wall thickness, provides said internal bead defining said sealing surface.

3. The container and closure combination as defined in claim 2 wherein said cap portion also includes an annular sealing ring surrounding said bung in spaced relation thereto and adapted to engage said rim which defines the mouth of said neck.

* * * * *